United States Patent [19]

Morris et al.

[11] Patent Number: 4,728,849

[45] Date of Patent: Mar. 1, 1988

[54] CAPSULE LIGHT SOURCE FOR ELECTRIC LAMP

[75] Inventors: Merle E. Morris, Lexington; Larry R. Fields, Winchester; George B. Kendrick, Lexington, all of Ky.

[73] Assignee: GTE Products Corporation, Danvers, Mass.

[21] Appl. No.: 882,553

[22] Filed: Jul. 7, 1986

[51] Int. Cl.[4] ..... H01J 5/16; H01J 5/48; H01J 5/50

[52] U.S. Cl. ..... 313/113; 313/318; 313/315; 313/578

[58] Field of Search ..... 313/111, 113, 318, 315, 313/578, 579, 43, 46, 623, 624, 625; 339/144 T, 144 R, 145 R; 362/306, 310

[56] References Cited

U.S. PATENT DOCUMENTS

| | | | |
|---|---|---|---|
| 4,101,798 | 7/1978 | Notelteirs et al. | 313/315 |
| 4,156,271 | 5/1979 | Vercellotti | 313/113 X |
| 4,243,907 | 1/1981 | Kohl et al. | 313/318 |
| 4,371,807 | 2/1983 | Eckhardt | 313/318 |
| 4,386,292 | 5/1983 | Rothwell et al. | 313/113 |
| 4,567,397 | 1/1986 | Wilhelm et al. | 313/318 |
| 4,608,624 | 8/1986 | Blaisdell et al. | 362/306 X |

*Primary Examiner*—David K. Moore
*Assistant Examiner*—Michael Horabik
*Attorney, Agent, or Firm*—Lawrence R. Fraley

[57] ABSTRACT

A light-emitting capsule for use in a reflector-type electric lamp utilized in such applications as display and track lighting. The capsule includes a hollow bulb portion containing a light source (coiled filament or arc) therein and an elongated sealed end including a flattened, narrow width segment and a protruding end segment. The end segment, preferably of similar configuration (cylindrical) as the bulb, is adapted for engaging the internal walls of the reflector's central opening to facilitate capsule positioning within such a reflector in both a precise and stable fashion. Additionally, the bulb portion is also capable of similar engagement to even further assure stabilized capsule orientation.

10 Claims, 6 Drawing Figures

CAPSULE LIGHT SOURCE FOR ELECTRIC LAMP

TECHNICAL FIELD

The invention relates to electric lamps and particularly to capsule light sources for electric lamps for use in such applications as down lighting, display lighting, flood lighting and track lighting.

BACKGROUND

Electric lamps, including those wherein a light-emitting capsule serves as the light source therefor, have been available for years. With particular regard to those lamps used in the aforementioned environments, typically two types have evolved. One such lamp, referred to in the art as a PAR (parabolic aluminized reflector) type lamp, typically utilizes a glass reflector and separate glass cover in which is positioned a coiled tungsten filament. A base member secured to the reflector is designed for being positioned within the required socket to provide the necessary connection to a power source (e.g., 120 VAC) for lamp operation. Examples of such lamps are illustrated in U.S. Pat. Nos. 4,506,316 (Thiry et al), 4,484,254 (Puckett et al) and 4,473,872 (Puckett et al), all of which are assigned to the same assignee as the instant invention. In some types of PAR lamps, it is also known to utilize a sealed, light-emitting capsule in place of the coiled filament mentioned above.

A second type of lamp of this variety includes a quartz or high silica glass envelope having therein a coiled tungsten filament and also including a base member located on the envelope, the base designed for being positioned within a socket as mentioned above. Lamps of this type are referred to in the lighting field with such product designations as R20 (the R standing for reflector), R30, R40, ER30 (the ER standing for ellipsoidal reflector) and ER40. Examples of such lamps are illustrated in U.S. Pat. Nos. 4,041,344 (LaGiusa), Re. 30,832 (LaGiusa) and 4,331,901 (Vrijer et al). Typically, such lamps utilize only a coiled filament as the source.

With particular regard to the present invention, there is defined a light-emitting capsule for being oriented within the lamp's reflector in a stable manner, thereby assuring accurate orientation of the capsule's light source relative to the reflector's internal reflecting surfaces. This positioning is attainable in an expeditious fashion while still assuring such accuracy of position. Additionally, the unique design of the capsule affords enhanced heat sinking to thus assure prolonged lamp life.

It is believed that such a capsule, adaptable to lamps of the type mentioned above as well as those used in other environments, would constitute a significant advancement in the lighting field.

DISCLOSURE OF THE INVENTION

It is, therefore, a primary object of this invention to enhance the electric lamp field by providing a light-emitting capsule for use in an electric lamp, which capsule can be facilely oriented within the lamp's reflector to assure a stable component therein.

It is another object of this invention to provide such a capsule which can be cost effectively produced on a mass production basis.

In accordance with one aspect of the invention. There is provided a light-emitting capsule for use in an electric lamp including a reflector having a forward concave reflecting portion, a rear, protruding neck portion and an opening extending through the rear neck portion. The capsule includes a hollow bulb portion adapted for being positioned within the concave reflecting portion of the reflector and having a light source disposed therein, and a sealed end portion adjacent the hollow bulb portion and adapted for being positioned within the opening within the rear neck portion of the reflector. The sealed end portion is of elongated configuration and includes a protruding end segment thereon, the protruding end segment adapted for engaging the internal surfaces of the opening within the rear neck portion of the reflector to stabilize the capsule within the reflector.

BEST MODE FOR CARRYING OUT THE INVENTION

For a better understanding of the present invention together with other and further objects, advantages and capabilities thereof, reference is made to the following disclosure and appended claims in connection with the above-described drawings.

Figure 1:
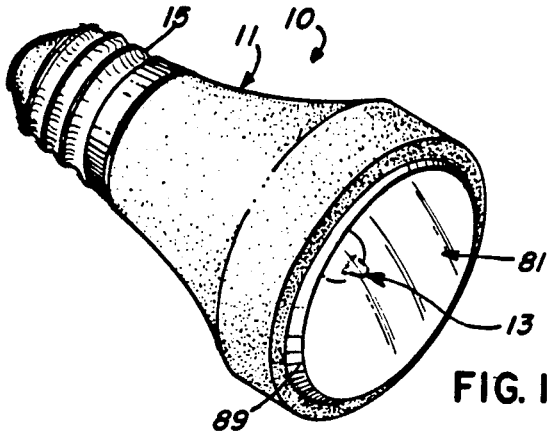
FIG. 1 is a perspective view of one example of an electric lamp capable of using the light-emitting capsule of the invention.

With particular attention to FIG. 1, there is shown an electric lamp 10 capable of having the light-emitting capsule 13 of the instant invention located therein. The invention is not limited to the specific lamp embodiment defined herein, however, in that it is clearly understood that the teachings provided herein are also applicable to other electric lamps wherein a reflector possessing similar characteristics (e.g., concave reflecting portion and extending rear neck portion) is utilized. As will be understood from the following, lamp 10 is highly efficient and of compact, rugged design. That is, lamp 10 is specifically designed for being of relatively small construction while capable of providing light output at levels comparative to the aforementioned, two types of known lamps.

Figure 2:
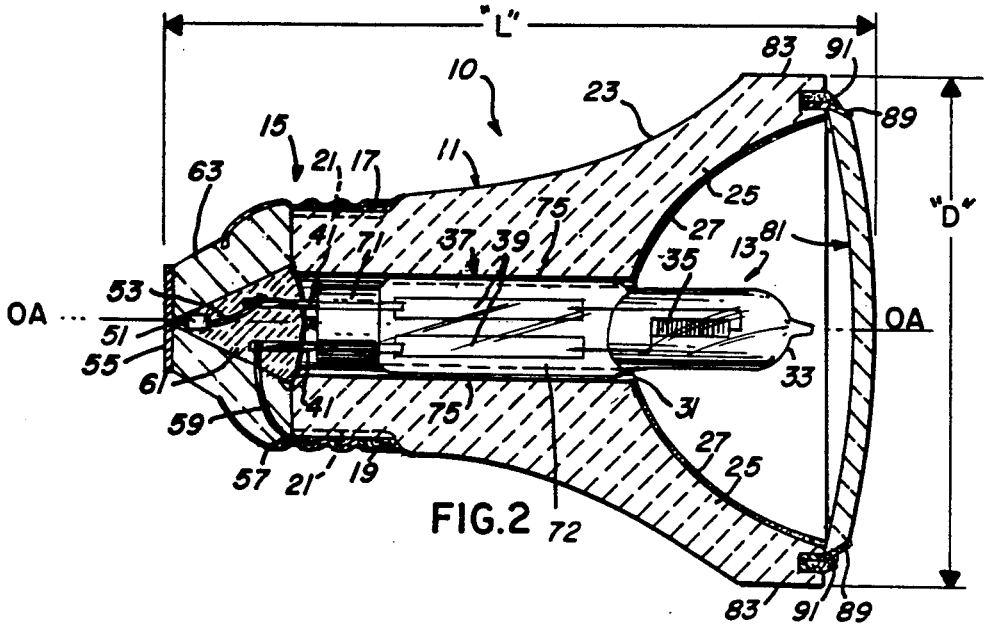
FIG. 2 is an enlarged side elevational view, in section, of the lamp of FIG. 1 illustrating the capsule of the invention located therein, the capsule including a coiled filament as the light source thereof.

In comparing FIGS. 1 and 2, lamp 10 includes a reflector 11, a light-emitting capsule 13 in accordance with a preferred embodiment of the invention located within the reflector, and a base member 15 which is secured to the reflector and adapted for being positioned within an appropriate socket (not shown) which in turn is electrically coupled to the power source (e.g., 120 VAC) for providing electrical energy to the lamp (and thus capsule 13). Base member 15, as described herein, is of substantially similar external configuration to known bases utilized in lamps of the type described herein such that lamp 10 is readily adaptable for use within existing socket constructions. In the example illustrated in the drawings, base member 15 possesses an external configuration similar to existing screw bases like those employed in the aforementioned PAR, R, and ER lamps. It is understood, however, that other types of bases are readily capable of use in the invention, including such alternative base configurations as those of the skirted screw, bayonet and end prong variety. It is further understood that the capsule of the invention, being capable of use in other types of electric lamps, may be used in such lamps which do not include a base member as described herein. Examples of such lamps include well known projection lamps commonly referred to in the art as "rim mount" projection lamps wherein a reflector (e.g., of borosilicate glass) excluding such a base is designed to accommodate a capsule therein. Externally projecting conductors of the capsule (from the reflector's rear or apex region) are designed for being connected to a suitable socket connector or the like which in turn forms part of the projector's electrical circuitry. It is thus understood that the capsule of the present invention is adaptable for use within such projection and similar type lamps, with relatively minor modification thereto being required.

As shown in FIGS. 1 and 2, base member 15 is positioned on an external surface of the rear, protruding neck portion 17 of reflector 11. Assembly (to be further described with the description of FIG. 3 below) is accomplished by sliding the substantially cylindrically shaped base member onto the similarly configured neck portion. Fixed securement is accomplished using a quantity of ceramic adhesive 19 or the like material, or, alternatively, may be provided by other means. One such alternative means is a procedure known as magnetic metalforming wherein an electrical coil is located relative to (about) the base member while the base member is positioned on the reflector's neck portion. A pulsed magnetic field is generated from electric current passing through the coil to exert a controllable pressure on the metal base member. High voltage capacitors are discharged through the coil, making this created field extremely intense. The field in turn induces current in the base member, setting up an opposing magnetic field. As a result, high pressures are generated, causing the metallic base to compress and form a tight fit on the reflector's neck.

In the embodiment shown in the drawings, elongated slots 21 (see also FIG. 4) are preferably provided within the reflector's neck portion to accommodate additional quantities of ceramic adhesive and thus provide added securement of base member 15. Alternatively (i.e., using the aforementioned metalforming technique), the neck portion's external surface may be substantially smooth and thus devoid of slots such as depicted in the drawings.

Reflector 11 is preferably of ceramic construction and thus capable of withstanding relatively high temperatures at which lamp 10 is specifically designed to operate. By way of example, reflector temperature for electric lamp 10 during operation thereof exceeded 250 degrees Celsius and in one instance (wherein the capsule 13 operated at 100 watts), the corresponding reflector temperature approached 350 degrees Celsius. The ability to operate at such relatively high temperatures in a safe and facile manner to provide light output at levels similar to those of the aforementioned type lamps constitutes a significant feature of lamp 10 and is due in part at least to the unique design of the instant invention. As illustrative of the lamp's compactness, lamp 10, in one embodiment, possessed an overall length of only about 2.14 inches (dimension "L" in FIG. 2) and an overall outer diameter of only about 2.00 inches (dimension "D" in FIG. 2).

As specifically shown in FIG. 2. reflector 11 further includes a forward, concave reflecting portion 23 which includes therein the concave reflecting surface 25 designed for reflecting light from capsule 13 during lamp operation. In a preferred embodiment, surface 25 was of substantially parabolic configuration and was glazed during formation of the green ceramic reflector. Surface 25 may also be faceted, fluted, peened or otherwise altered to affect light output. Steatite ceramic powder or other types of ceramic known in the industry, with controlled particle size, is pressed into the desired shape at high pressure (as is known in the ceramic industry) to obtain a high density "green" part. Other known methods such as slipcasting or molding a wet slurry may also be used. Liquid glaze is applied, preferably by spraying, onto the area containing the desired contour for the reflective surface while the ceramic is spinning in order to achieve a very precise thin coating. The glaze has been formulated such that it may be sintered to obtain a hard smooth surface at the same time and temperature as required for the ceramic to be sintered and fully cured. Optionally, the outside of the ceramic may be glazed with a clear glaze or with colors, surface finishes and patterns as desired for cosmetic purposes. Colorant may also be added to the ceramic bulk material to produce a final product having such a color.

In addition to the aforementioned glazing of the concave reflecting surface of reflector 11, a metallic reflective coating 27 (e.g., vapor deposited high purity aluminum) may be added over the glazed surface after sintering for the purpose of enhancing reflectivity.

Reflector 11, as shown, includes a central opening 31 therein which, as illustrated, passes from the concave reflecting portion 23 to the outer extremity of rear, neck portion 17. As will be described, opening 31 is preferably of substantially cylindrical configuration and lies coaxial with the optical axis (OA—OA) of the reflector. Accordingly, light-emitting capsule 13 is located substantially within opening 31 such that the hollow bulb portion 33 thereof projects within and is substantially surrounded by the concave reflecting surfaces 25 of the reflector. Capsule 13 is preferably a tungsten halogen capsule. By a tugsten halogen capsule is meant a capsule wherein the hollow bulb portion thereof includes a coiled (or coiled coil) tungsten filament (35) as the light source and an internal atmosphere containing a halogen, such as bromine. Tungsten halogen technology is known in the art and defines a procedure wherein a regenerative cycle is initiated when a tungsten halide is produced and chemically combines with particles evaporated from the energized filament to thus prevent evaporated tungsten particles from depositing on other filaments (if utilized) or on the envelope wall. Typically, capsules heretofore used in such technology have been constructed of quartz, high silica glass, or aluminosilicate glass, as is capsule 13. Alternatively, capsule 13 may comprise an arc discharge capsule (FIG. 6) of the general variety shown and described in U.S. Pats. Nos. 4,302,699 (Keeffe et al), 4,321,504 (Keeffe et al) and 4,454,450 (English et al), all of which are assigned to the assignee of this invention. Lamps having such capsules are also referred to as low wattage metal halide arc lamps and include a pair of spaced-apart electrodes 26 (FIG. 6) which extend within the tube (bulb). An arc is created between the electrodes during lamp operation, this arc serving as the light source. Capsules of the arc discharge and tungsten halogen variety typically include a press sealed end portion through which pass at least two electrical conductors which in turn project from the end thereof. Unlike capsules known in the art, however, the capsule of the instant invention includes a new and unique press sealed end portion 37 of substantially elongated configuration in comparison to the capsule's bulb portion. By way of example, the capsule envelope in one embodiment of the invention possessed an overall length (dimension "CL" in FIG. 3) of about 1.70 inch and a corresponding seal length (dimension "SL" in FIG. 3) of about 1.05 inch. By elongated is thus meant a capsule having a sealed end length within the range of from about thirty percent to about eighty percent of the overall capsule length. In the above example, the sealed length represented about sixty percent of the overall length. Preferably, the sealed portion is longer than the hollow bulb portion of capsule 13.

Figure 6:
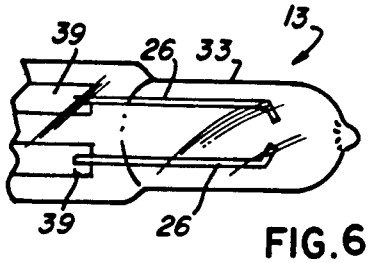
FIG. 6 is a partial view of a light-emitting capsule of the invention wherein a pair of spaced electrodes are used.

Located within elongated seal end portion 37 is a pair of elongated conductive foils 39 (e.g., molybdenum) which each serve to interconnect an inner and outer lead portion of one of the respective electrical conductors 41 of the invention. In the embodiment of FIG. 6, foils 39 serve to connect the electrodes 26 to respective conductors 41 similar to those shown in FIGS. 2 and 3. It is also understood that those parts of capsule 13 not shown in FIG. 6 are similar to those in FIGS. 2, 3 and 4. In one example, the outer portions of each of the conductors 41 was comprised of molybdenum material while the corresponding inner portion (that coupled to coiled filament 35, if used) were each of tungsten material. In the arc discharge embodiment in FIG. 6 the electrodes may be directly connected to the foils 39 such that inner portions as mentioned above may not be required. Each conductor 41 is in turn electrically coupled to a respective one of the two electrical contact portions of base member 15. As shown in FIG. 2, one conductor 41 is connected to a diode 51 through a conducting wire 53, which diode is in turn electrically connected to the conductive tip contact portion 55 of base member 15. The remaining conductor 41 is connected to the metallic shell contact portion 57 of the base member, preferably by a wire conductor 59. In a preferred example, the first conductor 53 is preferably of copper material and possesses an outer diameter of about 0.030 inch. The second wire conductor 59 was preferably of three parts (only one shown in the drawings for illustration purposes), each of nickel material and butt-welded to form a singular element. The three parts possessed outer diameters of 0.020 inch, 0.006 inch and 0.020 inch, respectively. Wire 59, having this small diameter middle part, thus serves as a fusible element. The outer shell contact portion 57 of base member 15 in one example was of nickel-plated brass, as was the tip contact portion 55. Understandably, solder (not shown) may be utilized in base configurations of this type to provide connections between such elements as disclosed herein.

Preferably, diode 51 is sealed within a quantity of ceramic adhesive 61 or the like which in turn is located within a reservoir portion of electrically insulative material 63 (e.g., glass) which also forms part of base member 15. This ceramic adhesive, which covers the diode, thus serves to insulate this component from heat generated by capsule 13 during lamp operation. In the preferred example, the ceramic adhesive utilized for material 61 was also white in color to thus reflect heat away from the diode. A preferred example of this material is available under the product designation Dylon 07 adhesive, sold by Dylon Industries. Inc., Berea, Ohio 44017.

The purpose of utilizing diode 51 is to reduce the line voltage for lamp 10. In one example, the aforementioned 120 VAC was reduced to 84 VAC to thus allow a more rugged and efficient tungsten coil. Accordingly, a coil less prone to sag or damage (e.g., during handling) is possible. Potting the diode within the aforementioned white ceramic adhesive, as stated, served to reflect heat from capsule 13 away from the diode during lamp operation. In one example, a temperature reduction of from about 330 degrees Celsius to about 220 degrees Celsius (e.g., when utilizing the aforementioned 100 watt capsule) was realized. Because the life of a diode is determined to a large extent on its operating temperature, locating the diode in the manner taught herein (within a depression and as far from bulb portion 33 as possible) assures extended life for both the diode and lamp.

Figure 3:
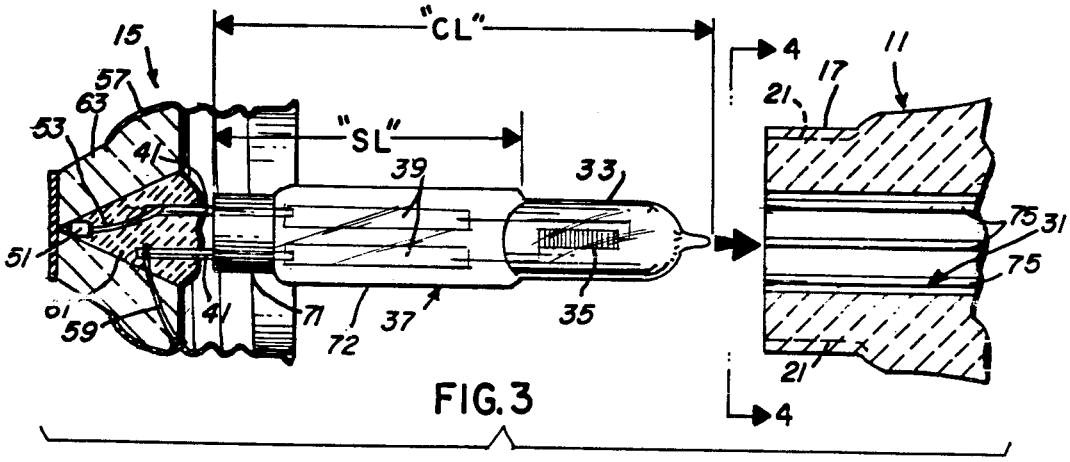
FIG. 3 is an exploded, partial side elevational view of the lamp of FIG. 2, in section, illustrating a preferred technique for positioning the invention within the reflector thereof.

In FIGS. 2 and 3, the elongated sealed end portion 37 of capsule 13 is shown to include a protruding end segment 71 which is designed for engaging an internal surface of opening 31 within the reflector's neck portion. Such engagement enables the capsule to be oriented in a stable manner within a reflector such as reflector 11 (e.g., during jarring as may occur during handling). In addition, it is also preferred that the hollow, cylindrical bulb portion of capsule 13 also engage the reflector opening's internal surface, thus providing a dual contact at spaced-apart locations between capsule and reflector. As shown in FIGS. 2 and 3, protruding end segment 71 and bulb portion 33 are both of similar (cylindrical) configuration, with each preferably possessing similar outer diameters. In one example, segment 71 and bulb 33 each possessed an external (outer) diameter of about 0.395 inch. The aforementioned sealed portion 37, as shown, also includes a segment 72 of flattened configuration and of a width slightly greater than the corresponding outer diameter for the two capsule parts it joins (segment 71 and bulb portion 33). In the above example (wherein the bulb and segment had an outer diameter of 0.395 inch, flattened segment 72 had an overall width of about 0.450 inch and a thickness of only about 0.138 inch.

The above capsule-reflector contact arrangement thus assures a lamp of more rugged construction. In addition, this spaced-apart means of contact facilitates optical alignment of the capsule's filament structure 35 within reflector 11. During assembly, capsule 13 is secured within the base member 15 to form the assembly depicted in FIG. 3. That is, the projecting conductors 41 are secured within the heat insulating ceramic adhesive 61 to provide a rigid capsule and base assembly. This entire assembly is then slidably positioned within the protruding neck portion 17 of reflector 11, as indicated in FIG. 3. During such positioning, the protruding end segment 71 and/or cylindrical bulb portion 33 slidably engage the reflector's internal surfaces while the metallic contact portion 57 of the base slidably engages the exterior surface of neck portion 17. Prior to such engagement, the aforementioned adhesive 19, if utilized, is applied (e.g., located within the respective slots 21, if utilized). The final result of this assembly is a capsule (and internal coil or, alternatively, an arc gap) in fixed, optical alignment within the lamp's reflector.

The aforementioned assembly technique enables the light center length (the distance from the coiled filament, or, alternatively, the arc location, to the respective reflective surfaces) to be precisely established when the capsule is connected to a base or similar component, such as base member 15. The aforementioned optical alignment is thus possible without further manipulation of the capsule after positioning within a lamp reflector such as defined herein. Extending the length of the press sealed end portion 37 of the capsule to the extent defined herein has also proven to reduce the seal temperature during lamp operation, thereby extending overall lamp life. That is, major portions of the sealed end are spaced at a substantial distance from the hot bulb portion of the capsule. In one example, a reduced seal temperature of about 100 degrees celsius was observed. It is estimated that such a substantial reduction in temperature will improve lamp life by a factor of five when the lamp is operated in the temperature ranges (e.g., at 350 degrees celsius) mentioned above.

Figure 4:
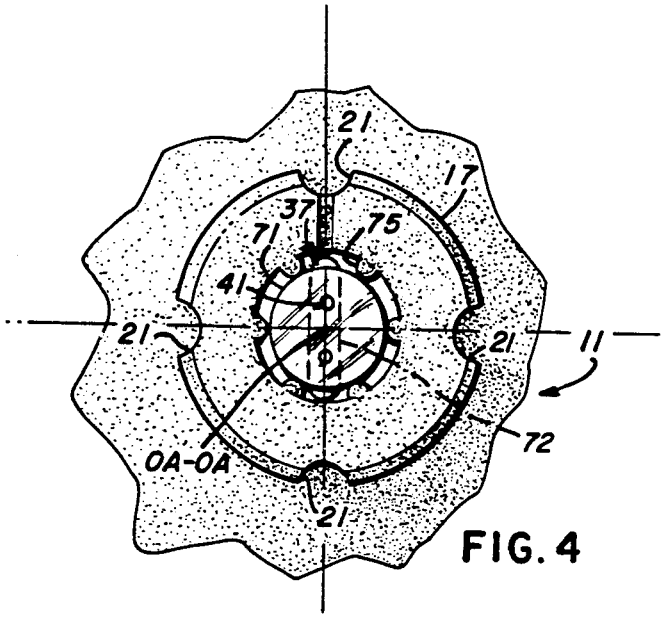
FIG. 4 is a partial end elevational view of the lamp's reflector as taken along the line 4—4 in FIG. 3, the invention being shown therein.

Improved (decreased) heat transference between capsule 13 and reflector 11 in the region of neck portion 17 is attained by the provision of a plurality of longitudinal, upstanding projections 75 which extend substantially along the entire length of the reflector's internal opening 31. As shown in FIG. 4, a total of six such projections are utilized, these being equally spaced around the reflector's inner surface. As also shown in FIG. 4, the substantially cylindrically shaped protruding end segment 71 of capsule 13 engages these projections when the capsule is fully positioned within the reflector's neck portion 17, the larger width, flattened sealed portion 37 extending between respective pairs of opposed projections. In this regard, it is also possible to utilize a protruding end section 71 (and bulb portion, if desired) of different configuration than the one depicted in the drawings. For example, an oblong configuration can be utilized, such that the exterior surfaces thereof engage fewer (e.g., two) than the total number of projections. Such engagement (with at least two projections) is also possible with an end section and/or bulb portion of cylindrical external configuration. In one instance, for example, only one of the two spaced contacting segments (end segment 71 or bulb portion 33) of capsule 13 contacted only two projections. Ideally, however, both end segment 71 and the bulb engage all (six) of the opening's projections 75 (i.e., as depicted in FIG. 4), provided acceptable tolerances can be attained. As understood from the above, a relatively close fit may thus exist between the capsule and the inner surfaces of opening 31. When engagement is provided between the capsule and projections as shown herein, the amount of heat transferred directly from the capsule to the ceramic material of reflector 11 is considerably reduced. Excessive heat transference in this region can in turn cause a considerable temperature gradient between the reflector's inner and outer regions, which in turn could place undue stress on the ceramic material and cause cracking or other deformities therein. Accordingly, provision of a multiple point type of contact as taught herein between capsule and reflector, which arrangement in turn provides for a corresponding plurality of air passages between these two components, substantially eliminates this potential problem. It is thus seen that the unique design of the instant invention, particularly the provision of an elongated, narrow and flattened intermediate segment (72) and an adjacent cylindrical end segment (71), contributes significantly to this highly advantageous feature.

The aforementioned point contact relationships between capsule and reflector has also proven advantageous with regard to the reflective coating 27, if utilized in a reflector-type lamp as lamp 10. That is, the defined positioning relationship also serves to adequately space the capsule from such a coating. It has been determined that direct contact between the capsule and such a coating may result in sublimation of the coating, the result of which may be to adversely affect the reflector's reflecting capability. This is overcome by the capsule-reflector positioning relationship described herein.

Figure 5:
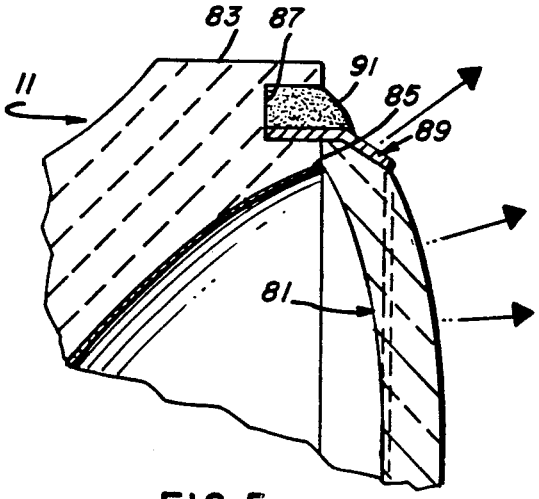
FIG. 5 is an enlarged, partial side elevational view, in section, of a holder member for use with the lamp of FIG. 1.

As seen in FIG. 2, electric lamp 10 further includes a light-transmitting cover means 81 which serves to cover the forward opening of the reflector's convave reflecting portion 23 and thus seal capsule 13 therein. Cover means 81. preferably of transparent glass material (e.g., borosilicate), is secured against the forwardmost surfaces of the annular rim portion 83 of reflector 11. In one embodiment, cover means 81 constituted a lens which served to direct the light output in a predetermined manner to provide the ultimate pattern desired on the subject area being so illuminated. If so used, this lens would preferably include a stippled internal surface (not shown) for diffusing light passing therethrough, particularly when the reflector's internal reflecting surface is faceted, peened, or similarly altered as mentioned above. As particularly shown in the much enlarged, fragmented view in FIG. 5, the annular cover means abuts against the aforementioned forwardmost surfaces (85). As also shown, this forwardmost portion of the reflector includes an annular groove or slot 87 therein. Retention of cover means 81 is accomplished by the provision of a holder member 89 which, also being of annular configuration, engages the outer surface of the cover means about the periphery thereof. As shown in FIG. 5, holder member 89 is secured within the reflector's groove 81 by a quantity of adhesive 91 (e.g., ceramic adhesive). Holder member 89 is of thin metallic material (e.g., aluminum) and, uniquely, is capable of flexing outwardly (as indicated by the directional arrows in FIG. 5) in response to expansion and contraction of the glass cover. Such expansion and contraction occurs due to the substantial difference in coefficients of thermal expansion between the ceramic material for the reflector and cover 81. By way of specific example, in one embodiment of lamp 10, the ceramic possesed a coefficient of thermal expansion of about $8.00\times10^{-6}$ cm./cm./degree Celsius while the borosilicate cover means possessed a coefficient of thermal expansion of about $4.00\times10^{-6}$ cm./cm./degree Celsius. The coefficient of thermal expansion for the ceramic adhesive 91 was about $7.50\times10^{-6}$ cm./cm./degree Celsius. It is thus understood that the cover means is not cemented to the reflector but instead is secured against the reflector in the abutting manner defined. This unique ability of the holder to flex during expansion and contraction of the retained cover prevents damage thereto.

There has thus been shown and described a light-emitting capsule capable of use within a reflector-type electric lamp of the variety described herein. This capsule, being of a unique design wherein a long, narrow width sealed end is employed in combination with an adjacent hollow bulb (preferably of shorter length than the sealed end) can be readily positioned within the lamp's reflector in not only stable fashion but also one wherein precise alignment between the capsule's light source (filament or arc) and reflector's reflecting surfaces is assured. The capsule's design also promotes heat transference in the neck region of such a reflector and enables a product which can be cost effectively produced on a mass production basis.

While there have been shown and described what are at present considered the referred embodiments of the invention, it will be obvious to those skilled in the art that various changes and modifications may be made therein without departing from the scope of the invention as defined by the appended claims.

What is claimed is:

1. A light emitting capsule for use in an electric lamp means wherein said lamp includes a reflector having a forward, concave reflecting portion, a rear, protruding neck portion, and an opening extending through said rear neck portion, said capsule being of a single unitary construction comprising;

a hollow bulb portion adapted for being positioned within said concave reflecting portion of said reflector and having a light source disposed therein;

said capsule further comprising a sealed end portion of elongated configuration wherein said elongated configuration includes a flattened segment adjacent said hollow bulb portion and a protruding end segment located at the opposite end of said flattened segment from said bulb portion and thereby spaced therefrom, said sealed end portion adapted for being positioned within said opening within said rear neck portion of said reflector and said protruding end segment adapted for engaging the internal surfaces of said opening within said rear neck portion of said reflector to stabilize said capsule within said reflector when said sealed end portion is positioned within said opening, both said hollow bulb portion and said sealed end portion, including said protruding end segment, being of glass material.

2. The light-emitting capsule according to claim 1 wherein both said protruding end segment of said sealed end portion and said hollow bulb portion of said capsule are adapted for engaging said internal surfaces of said opening within said reflector, said engagement occurring at spaced locations along said opening.

3. The light-emitting capsule according to claim 2 wherein said protruding end segment and said hollow bulb portion are of similar external configuration.

4. The light-emitting capsule according to claim 3 wherein both said protruding end segment and said hollow bulb portion are of cylindrical configuration.

5. The light-emitting capsule according to claim 1 further including a pair of spaced apart conductive foils of elongated configuration within said flattened segment, each of said conductive foils electrically coupled to said light source within said hollow bulb portion of said capsule.

6. The light-emitting capsule according to claim 1 wherein said light source within said hollow bulb portion is a coiled tungsten filament, said capsule being a tungsten halogen capsule.

7. The light-emitting capsule according to claim 1 further including a pair of spaced electrodes located within said hollow bulb portion of said capsule, said light source comprising an arc formed between said electrodes, said capsule being an arc discharge capsule.

8. The light-emitting capsule according to claim 1 wherein the length of said sealed end portion is within the range of from about thirty percent to about eighty percent of the overall length of said capsule.

9. The light-emitting capsule according to claim 8 wherein said length of said sealed end portion is about sixty percent of said overall length of said capsule.

10. The light-emitting capsule according to claim 1 wherein said flattened segment of said sealed portion is of a greater width than the widths of both said protruding end segment and said bulb portion.

* * * * *